US012139851B2

(12) United States Patent
Nakai et al.

(10) Patent No.: US 12,139,851 B2
(45) Date of Patent: Nov. 12, 2024

(54) FIBER BODY MANUFACTURING METHOD AND FIBER BODY MANUFACTURING APPARATUS

(71) Applicant: SEIKO EPSON CORPORATION, Tokyo (JP)

(72) Inventors: Yoko Nakai, Nagano (JP); Hideki Tanaka, Nagano (JP); Shinobu Yokokawa, Nagano (JP); Shunichi Seki, Nagano (JP); Naotaka Higuchi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 715 days.

(21) Appl. No.: 17/215,198

(22) Filed: Mar. 29, 2021

(65) Prior Publication Data

US 2021/0301463 A1 Sep. 30, 2021

(30) Foreign Application Priority Data

Mar. 31, 2020 (JP) ..... 2020-062283

(51) Int. Cl.
*D21B 1/32* (2006.01)
*D21B 1/08* (2006.01)
*D21G 9/00* (2006.01)

(52) U.S. Cl.
CPC ..... *D21B 1/32* (2013.01); *D21B 1/08* (2013.01); *D21G 9/0018* (2013.01)

(58) Field of Classification Search
CPC ..... D21B 1/32
USPC ..... 162/4
See application file for complete search history.

(56) References Cited

U.S. PATENT DOCUMENTS 7,758,724 B2 * 7/2010 Akai ..... D21H 17/36 162/158
2014/0027075 A1 1/2014 Yamagami et al.
2014/0290886 A1 * 10/2014 Nagai ..... D21F 9/02 162/252
2014/0374047 A1 12/2014 Yamagami
2016/0010278 A1 1/2016 Yamagami et al.
2016/0332333 A1 11/2016 Yamagami et al.
2017/0198434 A1 7/2017 Yamagami

FOREIGN PATENT DOCUMENTS

EP 3 584 360 A1 12/2019
JP 2012-144826 A 8/2012

* cited by examiner

*Primary Examiner* — Jacob T Minskey
(74) *Attorney, Agent, or Firm* — Global IP Counselors, LLP

(57) ABSTRACT

A fiber body manufacturing method includes: a dispersing step of dispersing a mixture containing a defibrated material which includes fibers and a binding agent which exhibits a binding property by moisture absorption, the mixture having a moisture content of 10 to 30 percent by weight; a depositing step of depositing the mixture dispersed in the dispersing step; a humidifying step of imparting moisture by water vapor or mist to the binding agent in a deposit deposited in the depositing step so as to exhibit the binding property; and a forming step of forming the deposit humidified in the humidifying step into a fiber body.

6 Claims, 3 Drawing Sheets

FIBER BODY MANUFACTURING METHOD AND FIBER BODY MANUFACTURING APPARATUS

The present application is based on, and claims priority from JP Application Serial Number 2020-062283, filed Mar. 31, 2020, the disclosure of which is hereby incorporated by reference herein in its entirety.

BACKGROUND

1. Technical Field

The present disclosure relates to a fiber body manufacturing method and a fiber body manufacturing apparatus.

2. Related Art

In recent years, for example, as disclosed in JP-A-2012-144826, a dry-type sheet manufacturing apparatus in which an amount of water is decreased as small as possible has been proposed. The sheet manufacturing apparatus disclosed in the above patent document includes a defibrating portion to defibrate a raw material, a mixing portion to mix a binding agent with a defibrated material produced in the defibrating portion, a depositing portion to deposit a mixture produced in the mixing portion, a moisture imparting portion to impart moisture to a deposit produced in the depositing portion, and a forming portion to heat and pressurize the deposit to which the moisture is imparted.

However, in the sheet manufacturing apparatus disclosed in JP-A-2012-144826, when a material, such as a starch, which exhibits a binding property by moisture absorption is used as the binding agent, the following problems may arise in some cases. In a related moisture imparting portion using water vapor or mist, a moisture amount is not sufficient. Hence, as a countermeasure, although a sufficient supply of moisture may be considered by decreasing a transport rate of the deposit, the productivity thereof is decreased. In addition, without decreasing the transport rate, an increase of a moisture supply amount per unit time, for example, by a method to spray water to the deposit may also be considered. However, when the moisture supply amount per unit time is increased, the amount of moisture absorption may vary between places of the deposit in some cases. As a result, the binding property varies, and a sheet quality may be degraded in some cases.

SUMMARY

According to an aspect of the present disclosure, there is provided a fiber body manufacturing method comprising: a dispersing step of dispersing a mixture containing a defibrated material which includes fibers and a binding agent which exhibits a binding property by moisture absorption, the mixture having a moisture content of 10 to 30 percent by weight; a depositing step of depositing the mixture dispersed in the dispersing step; a humidifying step of imparting moisture by water vapor or mist to the binding agent in a deposit deposited in the depositing step so as to exhibit the binding property; and a forming step of forming the deposit humidified in the humidifying step into a fiber body.

According to another aspect of the present disclosure, there is provided a fiber body manufacturing apparatus comprising, a dispersing portion to disperse a mixture containing a defibrated material which includes fibers and a binding agent which exhibits a binding property by moisture absorption, the mixture having a moisture content of 10 to 30 percent by weight; a depositing portion to deposit the mixture dispersed in the dispersing portion; a humidifying portion to impart moisture to the binding agent in a deposit deposited in the depositing portion so as to exhibit the binding property; and a forming portion to form the deposit humidified in the humidifying portion into a fiber body.

DESCRIPTION OF EXEMPLARY EMBODIMENTS

Hereinafter, a fiber body manufacturing method and a fiber body manufacturing apparatus according to the present disclosure will be described in detail with reference to preferable embodiments shown in the attached drawings.

First Embodiment

Figure 1:
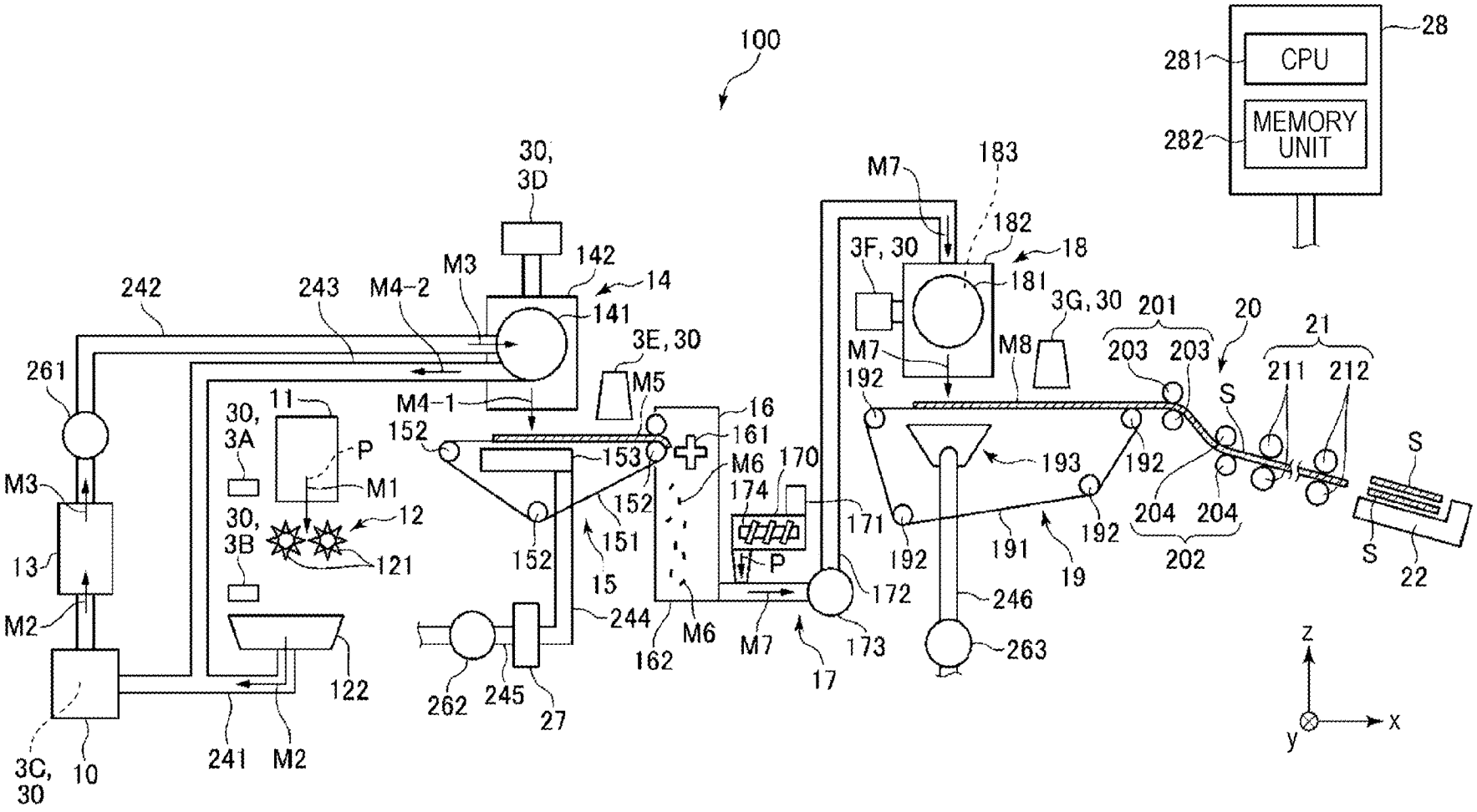
FIG. 1 is a schematic side view of a first embodiment of a fiber body manufacturing apparatus which performs a fiber body manufacturing method of the present disclosure.
Figure 2:
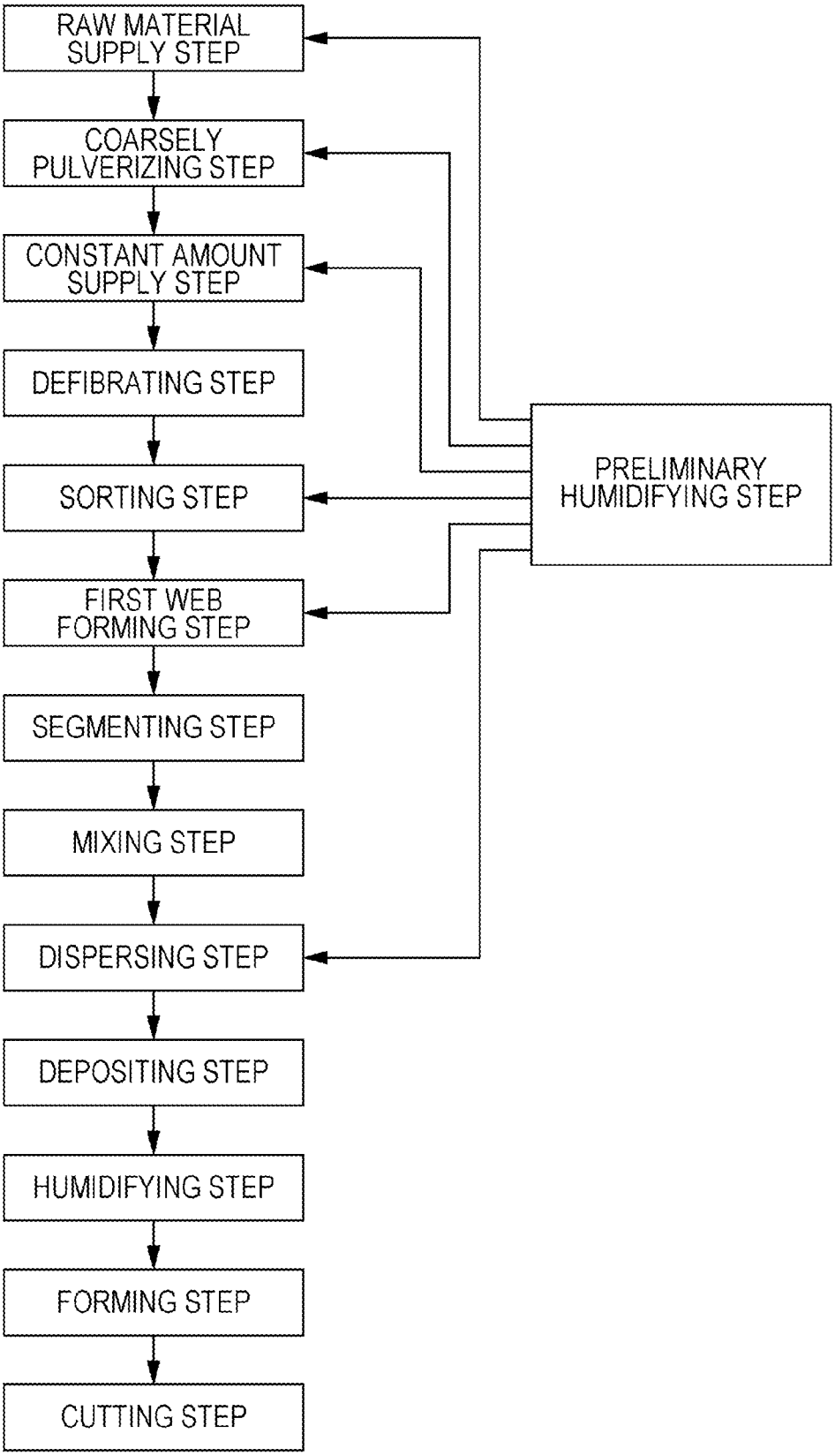
FIG. 2 is a flowchart showing one example of a control operation performed by a control portion of the fiber body manufacturing apparatus shown in FIG. 1.

FIG. 1 is a schematic side view showing a first embodiment of a fiber body manufacturing apparatus which performs a fiber body manufacturing method of the present disclosure. FIG. 2 is a flowchart showing one example of a control operation performed by a control portion of the fiber body manufacturing apparatus shown in FIG. 1.

In addition, hereinafter, for the convenience of illustration, as shown in FIG. 1, three axes orthogonal to each other are regarded as an x axis, a y axis, and a z axis. In addition, an x-y plane including the x axis and the y axis forms a horizontal plane, and the z axis represents a vertical direction. In addition, a direction represented by an arrow of each axis and a direction opposite thereto are called "+" and "−", respectively. In addition, an upper side of FIG. 1 is represented by "over" or "above", and a lower side of FIG. 1 is represented by "under" or "below" in some cases.

A fiber body manufacturing apparatus 100 shown in FIG. 1 is an apparatus to obtain a fiber body by coarsely pulverizing and defibrating a raw material M1, mixing a binding agent P therewith, depositing a mixture thus formed, and forming this deposit into the fiber body. In addition, the fiber body manufacturing apparatus 100 included humidification devices 30, and by the humidification devices 30, while each portion of the apparatus 100 is humidified, the treatments described above are performed.

In addition, as long as including fibers, a fiber body to be manufactured by the fiber body manufacturing apparatus 100 may have any shape, such a sheet shape as that of recycled paper or a block shape. In addition, the density of the fiber body is also not particularly limited, and a fiber body, such as a sheet, having a relatively high fiber density, a fiber body, such as a sponge, having a relatively low fiber density, or a fiber body having characteristics mixed between those of the fiber bodies described above may be formed. As the fiber body to be manufactured, a sheet S which is recycled paper will be described.

The fiber body manufacturing apparatus 100 shown in FIG. 1 includes a raw material supply portion 11, a coarsely pulverizing portion 12, a constant amount supply portion 10, a defibrating portion 13, a sorting portion 14, a first web forming portion 15, a segmenting portion 16, a mixing portion 17, a dispersing portion 18, a depositing portion 19, a forming portion 20, a cutting portion 21, a stock portion 22, a recovery portion 27, a control portion 28 which controls operations of the portions described above, and the humidification devices 30. The raw material supply portion 11 to the stock portion 22 are each a treating portion which treats a material including fibers.

In addition, in the fiber body manufacturing apparatus 100, as shown in FIG. 2, a raw material supply step, a coarsely pulverizing step, a constant amount supply step, a defibrating step, a sorting step, a first web forming step, a segmenting step, a mixing step, a dispersing step, a depositing step, a humidifying step, a forming step, and a cutting step are performed in this order. In addition, while steps from the raw material supply step to the dispersing step are performed, at least one preliminary humidifying step is performed. The preliminary humidifying step will be described later in detail.

Hereinafter, the structure of each portion will be described.

The raw material supply portion 11 is a portion which performs a raw material supply step of supplying the raw material M1 to the coarsely pulverizing portion 12. As this raw material M1, a sheet-shaped material including fibers may be mentioned. As the fibers, for example, there may be mentioned fibers derived from plants, fibers derived from animals, resin fibers, glass fibers, carbon fibers, or a mixture of at least two of those fibers mentioned above. Among the fibers mentioned above, in view of energy saving, the fibers derived from plants are preferably used as a primary component.

As the fibers derived from plants, for example, cellulose fibers, cotton, linter, kapok, flax, hemp, ramie, or silk may be mentioned, and those mentioned above may be used alone, or at least two types thereof may be used in combination. Among those mentioned above, fibers containing cellulose fibers as a primary component are preferable. The cellulose fibers are easily available, the formability thereof into the sheet S is excellent, and a sufficient strength can be obtained therefrom.

As the cellulose fibers, fibers derived from woody pulp are preferable. As the woody pulp, for example, there may be mentioned virgin pulp, such as hardwood pulp, softwood pulp, or cotton linter, kraft pulp, bleached chemi-thermo mechanical pulp, synthetic pulp, or pulp derived from old paper or recycled paper. Those mentioned above may be used alone, or at least two types thereof may be used in combination.

In addition, the cellulose fibers may be any fibrous material as long as containing a cellulose in the form of a compound (cellulose in a narrow sense) as a primary component, and a fibrous material containing, besides the cellulose in a narrow sense, hemicellulose and/or lignin may be included.

As the fibers derived from animals, for example, wool may be mentioned.

As the resin fibers, for example, fibers formed from a polyamide, a Tetoron, a rayon, a cupra, an acetate, a vinylon, an acrylic resin, a poly (ethylene terephthalate), or an aramid may be mentioned.

Although not particularly limited, an average fiber length of the fibers is preferably 0.10 to 50 mm, more preferably 0.20 to 5 mm, and further preferably 0.3 to 3 mm. Accordingly, binding by the binding agent P can be preferably performed, and an excellent formability and a sufficient strength can be obtained.

Although not particularly limited, an average fiber width is preferably 0.005 to 0.5 mm and more preferably 0.01 to 0.05 mm. Accordingly, binding by the binding agent P which will be described later is preferably performed, and an excellent formability and a sufficient strength can be obtained.

In addition, the form of the raw material M1 is not particularly limited and may be a woven cloth, a non-woven cloth, or the like. The raw material M1 may be, for example, recycled paper which is recycled/manufactured by defibration of old paper, Yupo paper (registered trademark) which is synthetic paper, or a material other than recycled paper.

The coarsely pulverizing portion 12 is a portion which performs a coarsely pulverizing step of coarsely pulverizing the raw material M1 supplied from the raw material supply portion 11 in a gas atmosphere, such as in the air. The coarsely pulverizing portion 12 includes a pair of coarsely pulverizing blades 121 and a chute 122. Since the pair of coarsely pulverizing blades 121 are rotated in directions opposite to each other, the raw material M1 is coarsely pulverized therebetween, that is, can be cut into coarsely pulverized pieces M2. The coarsely pulverized piece M2 preferably has a shape and a size suitable for a defibrating treatment to be performed in the defibrating portion 13, and for example, a small piece having a length of 100 mm or less is preferable, and a small piece having a length of 10 to 70 mm is more preferable.

The chute 122 is disposed below the pair of coarsely pulverizing blades 121 and has a funnel shape or the like. Accordingly, the chute 122 is able to receive the coarsely pulverized pieces M2 which fall after passing between the coarsely pulverizing blades 121.

The chute 122 is coupled to the defibrating portion 13 through a tube 241. The coarsely pulverized pieces M2 collected in the chute 122 are transported to the defibrating portion 13 through the tube 241.

In addition, at a certain point of the tube 241, the constant amount supply portion 10 is disposed. The constant amount supply portion 10 is a portion which performs a constant amount supply step of intermittently supplying a predetermined amount to the defibrating portion 13. The constant amount supply portion 10 includes a storage unit which temporarily stores the coarsely pulverized pieces M2 in the tube 241 and a discharge unit which discharges a predetermined amount of the coarsely pulverized pieces M2 in the storage unit to the defibrating portion 13. In addition, the discharge unit may be configured such that the amount of the coarsely pulverized pieces M2 is measured, and a predetermined amount thereof is supplied or may be configured such that a discharge state and a non-discharge state are switched at predetermined time intervals.

The defibrating portion 13 is a portion which performs a defibrating step of defibrating the coarsely pulverized pieces M2 in a gas atmosphere, that is, in a dry environment. By the defibrating treatment performed in this defibrating portion 13, defibrated materials M3 can be formed from the coarsely pulverized pieces M2. In the step described above, "defibrating" indicates that the coarsely pulverized pieces M2 in which fibers are bound to each other are disentangled into fibers independent of each other. In addition, the pieces thus disentangled form the defibrated materials M3. The defibrated material M3 has a line shape or a belt shape. In addition, the defibrated materials M3 may also be entangled with each other to form aggregates, that is, may be present so as to form so-called "damas".

In this embodiment, the defibrating portion 13 is formed, for example, of an impeller mill including a high-speed rotary blade and a liner located at an outer circumference of the rotary blade. The coarsely pulverized pieces M2 flowing into the defibrating portion 13 are defibrated after being sandwiched between the rotary blade and the liner.

In addition, by the rotation of the rotary blade, the defibrating portion 13 is able to generate a flow of air, that is, an air flow, from the coarsely pulverizing portion 12 to the sorting portion 14. Accordingly, the coarsely pulverized pieces M2 can be sucked to the defibrating portion 13 from the tube 241. In addition, after the defibrating treatment, the defibrated materials M3 can be supplied to the sorting portion 14 through a tube 242.

At a certain point of the tube 242, a blower 261 is disposed. The blower 261 is an air flow generator which generates an air flow toward the sorting portion 14. Accordingly, the supply of the defibrated materials M3 to the sorting portion 14 is promoted.

The sorting portion 14 is a portion which performs a sorting step of sorting the defibrated materials M3 by the lengths of the fibers. In the sorting portion 14, the defibrated materials M3 are sorted into first sorted materials M4-1 and second sorted materials M4-2 larger than the first sorted materials M4-1. The first sorted materials M4-1 each have a size suitable for a subsequent production of the sheet S. The average length of the first sorted materials M4-1 is preferably 0.10 to 50 mm. On the other hand, the second sorted materials M4-2 include insufficiently defibrated materials, excessively aggregated defibrated fibers, and the like.

The sorting portion 14 includes a drum 141 and a housing 142 receiving the drum 141.

The drum 141 is formed of a cylindrical net member and is a sieve to be rotated around a central shaft thereof. Into this drum 141, the defibrated materials M3 flow. In addition, when the drum 141 is rotated, defibrated materials M3 smaller than openings of the net are sorted as the first sorted materials M4-1, and defibrated materials M3 larger than the openings of the net are sorted as the second sorted materials M4-2.

The first sorted materials M4-1 fall from the drum 141.

On the other hand, the second sorted materials M4-2 are supplied to a tube 243 coupled to the drum 141. One side of the tube 243 opposite to the drum 141, that is, a downstream of the tube 243, is coupled to the tube 241. The second sorted materials M4-2 passing through this tube 243 meet the coarsely pulverized pieces M2 in the tube 241 and then flow into the defibrating portion 13 together with the coarsely pulverized pieces M2. Accordingly, the second sorted materials M4-2 are returned to the defibrating portion 13 and are again treated by the defibrating treatment together with the coarsely pulverized pieces M2.

In addition, while being dispersed in air, the first sorted materials M4-1 fall from the drum 141 toward the first web forming portion 15 located below the drum 141. The first web forming portion 15 is a portion which performs a first web forming step of forming a first web M5 from the first sorted materials M4-1. The first web forming portion 15 includes a mesh belt 151, three tension rollers 152, and a suction unit 153.

The mesh belt 151 is an endless belt, and the first sorted materials M4-1 are deposited thereon. This mesh belt 151 is stretched around the three tension rollers 152. In addition, by a rotational drive of the tension rollers 152, the first sorted materials M4-1 on the mesh belt 151 are transported to a downstream.

The first sorted materials M4-1 each have a size larger than openings of the mesh belt 151. Accordingly, the first sorted materials M4-1 are not allowed to pass through the mesh belt 151 and, hence, can be deposited on the mesh belt 151. In addition, while being deposited on the mesh belt 151, the first sorted materials M4-1 are transported to a downstream together with the mesh belt 151 and are then formed into a layered first web M5.

In addition, the first sorted materials M4-1 may be unfavorably mixed, for example, with dust and the like in some cases. The dust and the like may be generated, for example, by coarse pulverization and/or defibration. In addition, the dust and the like as described above can be recovered by the recovery portion 27 which will be described later.

The suction unit 153 is a suction mechanism which sucks air from a lower side of the mesh belt 151. Accordingly, the dust and the like passing through the mesh belt 151 can be sucked together with air.

In addition, the suction unit 153 is coupled to the recovery portion 27 through a tube 244. The dust and the like sucked in the suction unit 153 is recovered by the recovery portion 27.

To the recovery portion 27, a tube 245 is further coupled. In addition, at a certain point of the tube 245, a blower 262 is disposed. By the operation of this blower 262, a suction force can be generated in the suction unit 153. Accordingly, the formation of the first web M5 on the mesh belt 151 can be promoted. This first web M5 is a web from which the dust and the like are removed. In addition, by the operation of the blower 262, the dust and the like reaches the recovery portion 27 through the tube 244.

At a downstream of the mesh belt 151, the segmenting portion 16 is disposed. The segmenting portion 16 is a portion which performs a segmenting step of segmenting the first web M5 peeled away from the mesh belt 151. The segmenting portion 16 includes a rotatably supported propeller 161 and a housing 162 receiving the propeller 161. In addition, by the rotary propeller 161, the first web M 5 can be segmented. The first web M5 thus segmented forms fine segments M6. In addition, the fine segments M6 fall in the housing 162.

At a downstream of the segmenting portion 16, the mixing portion 17 is disposed. The mixing portion 17 is a portion which performs a mixing step of mixing the fine segments M6 and the binding agent P. This mixing portion 17 includes a binding agent supply unit 171, a tube 172, and a blower 173.

The tube 172 couples the housing 162 of the segmenting portion 16 to a housing 182 of the dispersing portion 18 and functions as a flow path through which a mixture M7 of the fine segments M6 and the binding agent P passes.

To a certain point of the tube 172, the binding agent supply unit 171 is coupled. The binding agent supply unit 171 includes a housing 170 receiving the binding agent P and a screw feeder 174 provided in the housing 170. By the rotation of the screw feeder 174, the binding agent P in the housing 170 is pushed out of the housing 170 and is supplied in the tube 172. The binding agent P supplied in the tube 172 is mixed with the fine segments M6 to form the mixture M7.

In this case, the binding agent P supplied from the binding agent supply unit 171 exhibits a binding property by moisture absorption, and by this binding force, the binding agent P has a function to bind the fibers to each other. Accordingly, the strength of the sheet S can be increased.

As the binding agent P, a material is not particularly limited as long as being capable of exhibiting a binding property by moisture absorption, and for example, there may be mentioned a natural derived material, such as sericin, starch, glycogen, dextrin, agarose, pectin, or agar; or a synthetic material, such as a water-soluble polymer including a PVA, an acrylic resin, a vinyl acetate resin, or an emulsion thereof.

In particular, as the binding agent P, a material containing starch is preferable since the starch can exhibits a sufficient binding property even by a small amount of moisture absorption and is also easily available. Accordingly, a more excellent biodegradability can be obtained, and the sheet S can be advantageously recycled.

Although not particularly limited, a supply amount of the binding agent P is set so that the content of the binding agent P in the sheet S is preferably approximately 1 to 25 percent by weight, more preferably approximately 2 to 20 percent by weight, and further preferably approximately 3 to 15 percent by weight. Accordingly, the sheet quality, in particular, the strength of the sheet S, can be more effectively increased.

That is, the content of the binding agent P in the sheet S which is a fiber body formed in the forming step described later is preferably 1 to 25 percent by weigh, more preferably 2 to 20 percent by weight, and further preferably 3 to 15 percent by weight. Accordingly, the sheet quality, in particular, the strength of the sheet S, can be more effectively increased.

In addition, the binding agent supply unit 171 may also supply, besides the binding agent P, other additives. The additives mentioned above are not particularly limited, and for example, there may be mentioned a colorant which colors the fibers, an aggregation suppressor which suppresses aggregation of the fibers, a flame retardant agent which enables the fibers and the like to hardly burn, and, besides the binding agent, a paper strength enhancer which increases the paper force of the sheet S, and those additives mentioned above may be used alone, or at least two types thereof may be used in combination.

In addition, at a certain point of the tube 172, the blower 173 is disposed at a downstream than the binding agent supply unit 171. By an operation of a rotary portion, such as a blade, of the blower 173, mixing between the fine segments M6 and the binding agent P is promoted. In addition, the blower 173 is able to generate an air flow toward the dispersing portion 18. By this air flow, in the tube 172, the fine segments M6 and the binding agent P can be stirred with each other. Accordingly, while the fine segments M6 and the binding agent P are placed in a uniformly dispersed state, the mixture M7 thereof is transported to the dispersing portion 18. In addition, the fine segments M6 in the mixture M7 are disentangled while passing through the tube 172 and are formed into finer fibers.

In addition, as shown in FIG. 1, the blower 173 is electrically coupled to the control portion 28, and the operation of the blower 173 is controlled thereby. In addition, by adjusting an air flow volume of the blower 173, an air volume to be supplied in a drum 181 can be adjusted.

In addition, although not shown in the drawing, an end portion of the tube 172 at a drum 181 side is branched in two ways, and the branched end portions are coupled to respective inlets (not shown) formed at the two end surfaces of the drum 181.

The dispersing portion 18 shown in FIG. 1 is a portion which performs a dispersing step in which entangled fibers of the mixture M7 are sequentially disentangled, discharged, and dispersed. The dispersing portion 18 includes the drum 181 to introduce and discharge the mixture M7 which contains the defibrated materials, a housing 182 which receives the drum 181, and a drive power source 183 which rotationally drives the drum 181.

The drum 181 is formed of a cylindrical net member and is a sieve to be rotated around a central shaft thereof. When the drum 181 is rotated, fibers and the like of the mixture M7 smaller than openings of the net are allowed to pass through the drum 181. In this step, the mixture M7 is disentangled and then discharged together with air. That is, the drum 181 functions as a discharge unit which discharges a material including the fibers.

Although not shown in the drawing, the drive power source 183 includes a motor, a decelerator, and a belt. The motor is electrically coupled to the control portion 28 through a motor driver. A rotation force output from the motor is decelerated by the decelerator. The belt is formed, for example, of an endless belt and is stretched around an output shaft of the decelerator and the outer circumference of the drum. Accordingly, a rotation force of the output shaft of the decelerator is transmitted to the drum 181 through the belt.

In addition, while being dispersed in air, the mixture M7 discharged from the drum 181 falls toward the depositing portion 19 located below the drum 181. The depositing portion 19 is a portion which performs a depositing step of depositing the mixture M7 to form a second web M8 which is a deposit. The depositing portion 19 includes a mesh belt 191, tension rollers 192, and a suction unit 193.

The mesh belt 191 is a mesh member, and in the structure shown in the drawing, an endless belt is used. In addition, on the mesh belt 191, the mixture M7 dispersed in and discharged from the dispersing portion 18 is deposited. This mesh belt 191 is stretched around the four tension rollers 192. In addition, by a rotational drive of the tension rollers 192, the mixture M7 on the mesh belt 191 is transported to a downstream.

In addition, in the structure shown in the drawing, as one example of the mesh member, the structure using the mesh belt 191 is formed; however, the present disclosure is not limited thereto, and for example, a flat plate may also be used.

In addition, most of the mixture M7 on the mesh belt 191 is larger than openings of the mesh belt 191. Accordingly, the mixture M7 is not allowed to pass through the mesh belt 191 and hence, is deposited on the mesh belt 191. In addition, while depositing on the mesh belt 191, the mixture M7 is transported to a downstream together with the mesh belt 191, and hence, a layered second web M8 is formed.

The suction unit 193 is a suction mechanism which sucks air from a lower side of the mesh belt 191. Accordingly, the mixture M7 can be sucked on the mesh belt 191, and hence, the deposition of the mixture M7 on the mesh belt 191 can be promoted.

To the suction unit 193, a tube 246 is coupled. In addition, at a certain point of this tube 246, a blower 263 is disposed. By the operation of this blower 263, a suction force can be generated in the suction unit 193.

In addition, in the depositing portion 19, the humidification device 30 performs humidification on the second web M8. Accordingly, the binding agent P in the second web M8 exhibits a binding property and hence is able to bind fibers to each other. The binding between fibers described above will be described later in detail.

At a downstream of the depositing portion 19, the forming portion 20 is disposed. The forming portion 20 is a portion which performs a forming step of forming a sheet S from the second web M8. This forming portion 20 includes a pressurizing unit 201 and a heating unit 202.

The pressurizing unit 201 includes a pair of calendar rollers 203, and between the calendar rollers 203, the second web M8 can be pressurized without being heated. Accordingly, the density of the second web M8 can be increased. In addition, this second web M8 is transported to the heating unit 202. In addition, one of the pair of calendar rollers 203 is a main drive roller which is driven by an operation of a motor not shown, and the other roller is a driven roller.

The heating unit 202 includes a pair of heating rollers 204, and between the heating rollers 204, while being heated, the second web M8 can be pressurized. By this heat/pressure application, moisture in the second web M8 is evaporated, and the moisture content of the second web M8 is decreased. In association with this decrease in moisture content, the binding property of the binding agent P is deactivated, and the fibers can be fixed so as to be bound therebetween. Accordingly, a sheet S having a sufficient strength can be obtained.

Subsequently, this sheet S is transported to the cutting portion 21. In addition, one of the pair of heating rollers 204 is a main drive roller which is driven by an operation of a motor not shown, and the other is a driven roller.

At a downstream of the forming portion 20, the cutting portion 21 is disposed. The cutting portion 21 is a portion which performs a cutting step of cutting the sheet S. This cutting portion 21 includes first cutters 211 and second cutters 212.

The first cutters 211 are cutters which cut the sheet S in a direction intersecting a transport direction of the sheet S, in particular, in a direction orthogonal thereto.

The second cutters 212 are cutters which cut the sheet S at a downstream of the first cutters 211 in a direction parallel to the transport direction of the sheet S. This cutting is performed to have a predetermined width of the sheet S by removing the two side ends, that is, unnecessary ends in a+y axis direction and a−y axis direction, of the sheet S, and the ends thus removed by the cutting are each called a so-called "end slice".

By the cutting performed using the first cutters 211 and the second cutters 212, a sheet S having a desired shape and size can be obtained. In addition, this sheet S is further transported to a downstream and then stored in the stock portion 22.

In addition, the forming portion 20 is not limited to the structure in which the sheet S is formed as described above, and for example, the structure in which a fiber body having a block shape, a spherical shape, or the like is formed may also be used.

The individual portions of the fiber body manufacturing apparatus 100 described above are each electrically coupled to the control portion 28. In addition, the operations of the portions described above are each controlled by the control portion 28.

The control portion 28 includes a central processing unit (CPU) 281 and a memory unit 282. The CPU 281 is able to perform various programs stored in the memory unit 282 and, for example, is able to perform various judgments, various commands, and the like.

In the memory unit 282, for example, various types of programs, such as a program for manufacturing the sheet S, various types of calibration curves, tables, and the like, are stored.

In addition, this control portion 28 may be embedded in the fiber body manufacturing apparatus 100 or may be provided as an external apparatus, such as an external computer. In addition, for example, the external apparatus may be communicated with the fiber body manufacturing apparatus 100 through a cable or the like, or in the case of wireless communication, the external apparatus may be coupled to the fiber body manufacturing apparatus 100, for example, through a network, such as the internet.

In addition, the CPU 281 and the memory unit 282 may be integrally configured as one unit; the CPU 281 is embedded in the fiber body manufacturing apparatus 100, and the memory unit 282 may be provided in an external apparatus, such as an external computer; or the memory unit 282 is embedded in the fiber body manufacturing apparatus 100, and the CPU 281 may be provided in an external apparatus, such as an external computer.

Next, the humidification device 30 will be described.

Figure 3:
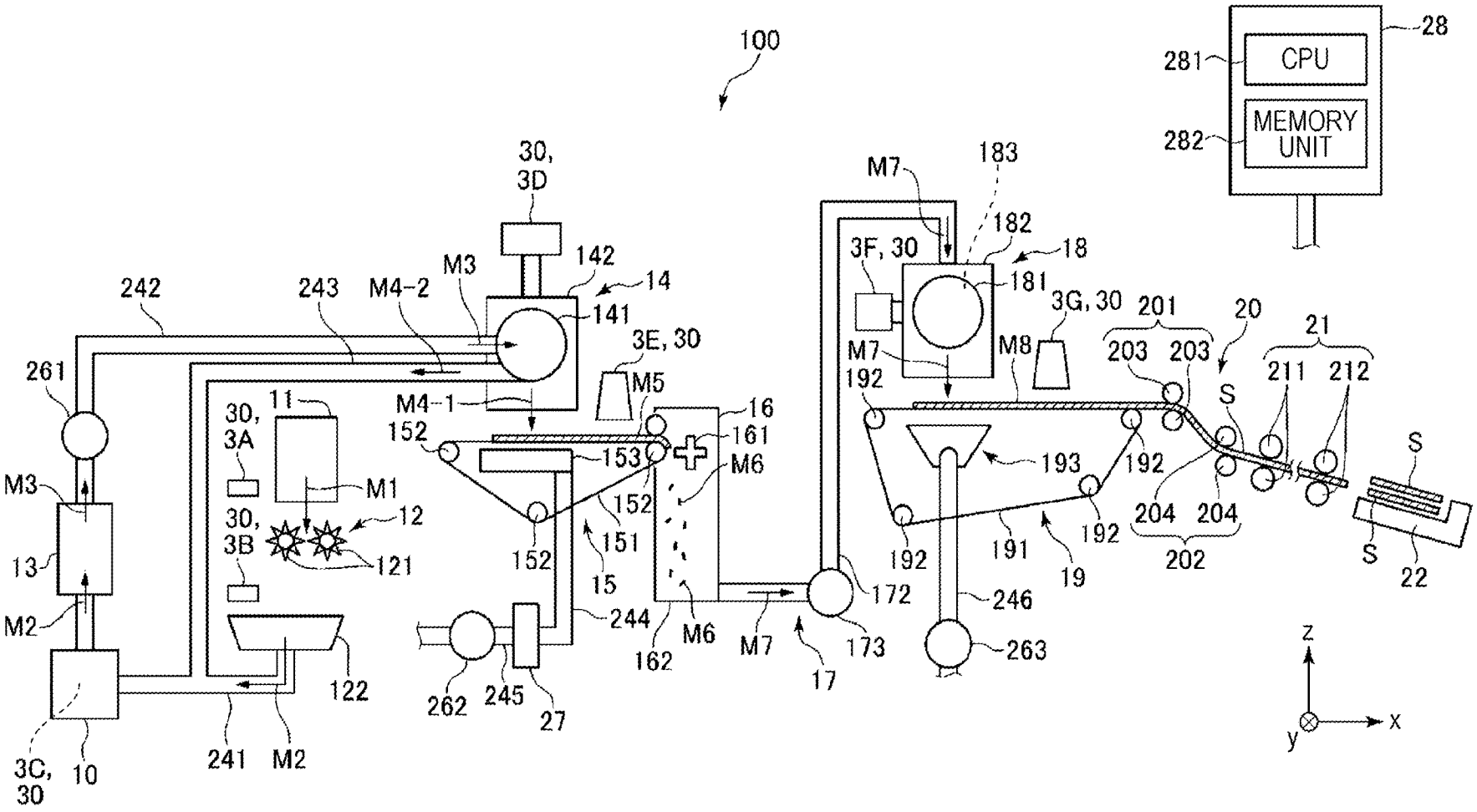
FIG. 3 is a schematic side view of a second embodiment of the fiber body manufacturing apparatus which performs the fiber body manufacturing method of the present disclosure.

As shown in FIG. 3, the humidification device 30 is a device which humidifies each portion of the fiber body manufacturing apparatus 100 by imparting moisture to a material in the portion. A plurality of humidifiers, that is, a humidifier 3A, a humidifier 3B, a humidifier 3C, a humidifier 3D, a humidifier 3E, a humidifier 3F, and a humidifier 3G, is provided. The operations of the humidifiers 3A to 3G are independently controlled by the control portion 28. In addition, the control is not limited to that performed by the control portion 28, and an exclusive control portion which controls the humidifiers 3A to 3G may be provided.

The humidifier 3A is disposed in the raw material supply portion 11, that is, in particular, in a stock unit which stocks the raw material M1. The humidifier 3A is a device which humidifies the raw material M1.

The humidifier 3B is disposed in the coarsely pulverizing portion 12, that is, in particular, at an upper side of the chute 122. The humidifier 3B is a device which humidifies the coarsely pulverized pieces M2.

The humidifier 3C is disposed in the constant amount supply portion 10 and is a device which humidifies the coarsely pulverized pieces M2.

The humidifier 3D is disposed in the sorting portion 14 and, in particular, is coupled to the drum 141. The humidifier 3D is a device which humidifies the defibrated materials M3.

The humidifier 3E is disposed in the first web forming portion 15, that is, in particular, at an upper side of the mesh belt 151. The humidifier 3E is a device which humidifies the first web M5.

The humidifier 3F is disposed in the dispersing portion 18 and, in particular, is coupled to the drum 181. The humidifier 3F is a device which humidifies the mixture M7.

The humidifier 3G is disposed in the depositing portion 19, that is, in particular, at an upper side of the mesh belt 191. The humidifier 3G is a device which humidifies the second web M8.

The humidifier 3G is a device which emits water vapor or mist for humidification. That is, the humidifier 3G is a vaporizing type or a mist type humidifier. In addition, although not particularly limited, the humidifiers 3A to 3F are each preferably a vaporizing type or a mist type humidifier.

As the vaporizing type humidifier, for example, a humidifier formed of a container which stores water, a filter provided in the container, and a fan may be mentioned. The filter is disposed in the container and is formed from a porous material, such as a woven cloth, a non-woven cloth, or a sponge, which is capable of absorbing water in the container. This filter absorbs water in the container, and by an air flow generated by the fan, evaporation of the water in the filter is promoted. In addition, by emission of this humidified air, humidification is performed.

As the vaporizing type humidifier, for example, a humidifier formed of a container which stores water and an ultrasonic vibration element may be mentioned. The ultrasonic vibration element generates an ultrasonic vibration and forms a water column in the container. In association with the formation of the water column, mist is generated therearound, and by emission of this mist, humidification is performed.

In addition, when at least one of the humidifiers 3A to 3F is provided, the other humidifiers may be omitted.

By the humidification devices 30 as described above, the materials which pass through the respective portions are humidified, and as a result, the following effects A and B can be obtained.

The effect A is an effect which exhibits a binding property of the binding agent P so as to increase the strength of the sheet S.

The effect B is an effect which improves the sheet quality since the quantitativity can be secured by preventing or suppressing the materials in process or in transportation from being formed into "damas" by static electrification or from being adhered to walls and the like of the apparatus.

Although depending on a material to be used for the binding agent P, in order to obtain the effect A, a moisture content of the second web M8 is preferably increased to 15 to 40 percent by weight. When the moisture content of the second web M8 is increased only by the humidifier 3G so as to obtain the binding property of the binding agent P, an amount of moisture absorption by the humidifier 3G is preferably increased. However, when the amount of moisture absorption per unit time in the second web M8 is excessively large, the amount of moisture absorption is liable to vary in the second web M8, and in this case, the binding property may vary, and as a result, the sheet quality may be degraded in some cases. On the other hand, a decrease in rotation rate of the mesh belt 191, that is, a decrease in transport rate of the second web M8, may be considered by decreasing the amount of moisture absorption per unit time by the humidifier 3G. However, in this case, the productivity of the sheet S is degraded. As described above, when the binding agent P is used, an improvement in sheet quality and an increase in productivity of the sheet S are difficult to achieve at the same time.

Accordingly, in the fiber body manufacturing apparatus 100, the humidifiers 3A to 3F perform preliminary humidification so as to enable the mixture M7 discharged from the dispersing portion 18 to have a moisture content of 10 to 20 percent by weight. In addition, in this step, the binding agent P has not exhibited a sufficient binding property, and while "damas" are suppressed from being formed, transportation and discharge of the materials can be performed. In addition, the second web M8 formed by deposition of the mixture M7 which is preliminarily humidified is humidified by the humidifier 3G so as to exhibit the binding property of the binding agent P. By the structure as described above, while the amount of moisture absorption per unit time by the humidifier 3G is set to relatively small, the sheet S can be manufactured in the state in which the rotation rate of the mesh belt 191 is sufficiently increased. Hence, while moisture is uniformly supplied to the binding agent P in the second web M8, the second web M8 can be rapidly transported. As a result, the quality of the sheet S can be improved, and at the same time, the productivity thereof can also be enhanced.

In addition, when the moisture content of the mixture M7 is excessively small, the amount of moisture absorption per unit time by the humidifier 3G is required to be increased, and in the second web M8, the supply amount of moisture may vary in some cases. As a result the sheet quality is degraded. On the other hand, when the moisture content of the mixture M7 is excessively high, depending on the type of binding agent P, the binding agent P may exhibit a binding property in a flow path to the dispersing portion 18, and "damas" may be unfavorably formed from the fibers in some cases. In addition, the dispersibility of the cellulose fibers themselves may also be degraded. As a result, since the dispersion may not be preferably performed from the dispersing portion 18, and/or the thickness of the second web M8 may partially vary, the sheet quality, such as the tensile strength, is degraded.

In addition, the moisture content of the mixture M7 may be measured, for example, using a sample of the mixture which was dispersed by a heating dry type moisture analyzer ("MS70/MX50/MF50/ML50", manufactured by A&D Company, Limited) or the like.

The humidifiers 3A to 3F as described above are each a device which performs a preliminary humidifying step of performing preliminary humidification, and the humidifier 3G is a device which performs a humidifying step of enabling the binding agent P to exhibit a binding property. That is, according to the structure shown in the drawing, in the raw material supply step, the coarsely pulverizing step, the constant amount supply step, the sorting step, the first web forming step, and the dispersing step, the preliminary humidifying steps are performed in a time overlapping manner, and after the second web forming step, the humidifying step is performed.

As described above, the fiber body manufacturing method of the present disclosure includes, before the dispersing step, at least one preliminary humidifying step of performing humidification so that the mixture M7 has a moisture content of 10 to 30 percent by weight. Accordingly, as described above, while the amount of moisture absorption per unit time by the humidifier 3G can be set to relatively small, and while the rotation rate of the mesh belt 191 is sufficiently increased, the sheet S can be manufactured.

In addition, the moisture content of the mixture M7 thus dispersed may be 10 to 30 percent by weight, and the moisture contents obtained by the humidifiers 3A to 3F are each not particularly limited.

In addition, in the preliminary humidifying step, humidification is performed by supplying humidified air having preferably a humidity of 60% to 95% and more preferably a humidity of 65% to 90%. In addition, the humidified air is preferably supplied to the mixture M7 after being adjusted with water vapor or mist. Accordingly, while moisture is prevented or suppressed from being excessively supplied to the binding agent P, the fibers or the binding agent P can be humidified.

In addition, the moisture content of the second web M8 after being humidified by the humidifier 3G, that is, the moisture content of the second web M8 which is the deposit humidified in the humidifying step, is preferably 15 to 50 percent by weight and more preferably 15 to 30 percent by weight. Accordingly, moisture can be appropriately contained in the second web M8, and the binding property of the binding agent P can be effectively obtained. When the moisture content of the second web M8 is excessively low, depending on the type of binding agent P, the binding property may not be sufficiently obtained, and the sheet quality may be degraded in some cases. On the other hand, when the moisture content of the second web M8 is excessively high, a heating temperature or a heating time in the forming step is required to be increased, and as a result, an increase in electricity consumption or a decrease in productivity may arise in some cases.

In the dispersing step, the moisture content of the fibers and the moisture content of the binding agent P are each 50 percent by weight or less and preferably 40 percent by weight or less. Accordingly, energy necessary for drying of the fibers can be reduced. In addition, since the starch exhibits no binding property in the dispersing step, the sheet quality can be more effectively improved. When at least one of the moisture content of the fibers and the moisture content of the binding agent P is excessively high, "damas" are liable to be generated in the mixture M7, and the sheet quality may be unfavorably degraded in some cases.

In addition, the difference between the moisture content of the mixture M7 in the dispersing portion 18 and the moisture content of the second web M8 humidified by the humidifier 3G is preferably 4 to 25 percent by weight and more preferably 7 to 20 percent by weight. Accordingly, in consideration of evaporation of moisture of the mixture M7 during the dispersion, an appropriate amount of moisture can be imparted in the humidifying step.

In addition, in the forming step, the heating temperature by the heating unit 202 is preferably 50° C. to 120° C. and more preferably 70° C. to 100° C. Accordingly, the moisture of the second web M8 can be appropriately evaporated, and hence, the sheet quality can be improved. As has thus been described, the fiber body manufacturing method according to the present disclosure includes the dispersing step of dispersing the mixture M7 containing the defibrated materials M3 which includes fibers and the binding agent P which exhibits a binding property by moisture absorption, the mixture having a moisture content of 10 to 30 percent by weight; the depositing step of depositing the mixture M7 dispersed in the dispersing step; the humidifying step of imparting moisture by water vapor or mist to the binding agent P in the second web M8 which is a deposit deposited in the depositing step so as to exhibit the binding property; and the forming step of forming the second web M8 humidified in the humidifying step into the sheet S as the fiber body. Accordingly, while the amount of moisture absorption per unit time in the humidifying step is set to relatively small, and the transport rate of the second web M8 to the forming portion 20 is sufficiently increased, the sheet S can be manufactured. Hence, while moisture is uniformly supplied to the binding agent P in the second web M8, the second web M8 can be rapidly transported. As a result, while the quality of the sheet S is improved, the productivity thereof can be enhanced.

In addition, the fiber body manufacturing apparatus 100 according to the present disclosure includes the dispersing portion 18 to disperse the mixture M7 containing the defibrated materials M3 which includes fibers and the binding agent P which exhibits a binding property by moisture absorption, the mixture having a moisture content of 10 to 30 percent by weight; the depositing portion 19 to deposit the mixture M7 dispersed in the dispersing portion 18; the humidifier 3G to impart moisture by water vapor or mist to the binding agent P in the second web M8 which is a deposit deposited in the depositing portion 19 so as to exhibit a binding property; and the forming portion 20 to form the second web M8 humidified by the humidifier 3G into the sheet S as the fiber body. Accordingly, while the amount of moisture absorption per unit time is set to relatively small in the humidifier 3G, and the transport rate of the second web M8 to the forming portion 20 is sufficiently increased, the sheet S can be manufactured. Hence, while moisture is uniformly supplied to the binding agent P in the second web M8, the second web M8 can be rapidly transported. As a result, while the quality of the sheet S is improved, the productivity thereof can be enhanced.

In addition, in this embodiment, although the structure in which since the humidifiers 3A to 3F perform the preliminary humidifying steps, the moisture content of the mixture M7 is set to 10 to 30 percent by weight has been described, the present disclosure is not limited thereto, and without using the humidifiers 3A to 3F, by a cartridge method or the like, a mixture M7 having a moisture content of 10 to 30 percent by weight may be supplied to the dispersing portion 18.

In addition, as shown in the drawing, when the defibrated materials M3 are materials obtained such that the raw material M1 including fibers is coarsely pulverized and then defibrated, at least one of the preliminary humidifying steps is preferably performed before the raw material is defibrated. When the raw material is defibrated while the fibers contain a certain amount of moisture, damage done on the fibers can be effectively reduced. Hence, the strength of the sheet S and recycle repeatability thereof can be improved.

Second Embodiment

FIG. 3 is a schematic side view showing a second embodiment of the fiber body manufacturing apparatus which performs the fiber body manufacturing method of the present disclosure.

Hereinafter, with reference to this drawing, although the second embodiment of the fiber body manufacturing method and the fiber body manufacturing apparatus of the present disclosure will be described, points different from those of the first embodiment described above will be primarily described, and points similar to those described above will be omitted.

As shown in FIG. 3, in the fiber body manufacturing apparatus 100 of this embodiment, the binding agent supply unit 171 shown in FIG. 1 is omitted. Hence, the size of the fiber body manufacturing apparatus 100 can be reduced. In addition, in this embodiment, the binding agent P is contained in the raw material M1. That is, in this embodiment, in the state in which the fibers and the binding agent P are contained, steps from the raw material supply step to the cutting step are performed. In addition, in this embodiment, the mixing step supplies no binding agent P and is a step of preferably stirring and mixing the defibrated materials M3 and the binding agent P.

In addition, when the raw material M1 contains the binding agent P as in the case of this embodiment, the content of the binding agent P in the raw material M1 is preferably larger than a targeted content of the binding agent P in the sheet S, is preferably 1 to 50 percent by weight, and is more preferably 2 to 40 percent by weight. Accordingly, for example, in the first web forming step or the like, even if the amount of the binding agent P is decreased due to the suction by the suction unit 153, the targeted content of the binding agent P in the sheet S can be easily set. Hence, the strength of the sheet S can be sufficiently secured.

In addition, the form of the binding agent P in the raw material M1 is not particularly limited as long as being a solid, and for example, particles, fibers, or the like may be mentioned.

In addition, when the binding agent P is contained in the raw material M1 as is the case of this embodiment, at least one preliminary humidifying step is particularly preferably performed before the raw material M1 reaches the defibrating portion 13. That is, the preliminary humidifying step is particularly preferably performed by at least one of the humidifiers 3A to 3C. Since the defibration is performed while the fibers and the binding agent P contain a certain amount of moisture, damage done on the fibers can be effectively reduced. Hence, the strength of the sheet S and the recycle repeatability thereof can be improved.

Heretofore, although the fiber body manufacturing method and the fiber body manufacturing apparatus of the present disclosure have been described with reference to the embodiments shown in the drawings, the present disclosure is not limited thereto, and the steps and the individual portions of the fiber body manufacturing method and the fiber body manufacturing apparatus may be replaced with arbitrary steps and portions which are able to achieve functions similar to those described above. In addition, arbitrary steps and/or constituent elements may also be added to those described above.

EXAMPLES

Next, concrete examples of the present disclosure will be described.

1. Production of Fiber Body

Example 1

As the raw material, used old paper in which printing was performed on copy paper ("Recycle Cut Size G80", manufactured by Mitsubishi Paper Mills Limited) by a printer "PX-M7050FX", manufactured by Seiko Epson Corporation) was charged in the raw material supply portion 11 shown in FIG. 1, and the sheet S was manufactured.

In addition, as the binding agent to be charged from the mixing portion 17 shown in FIG. 1, an acid-treated starch ("NSP-EA", manufactured by Nippon Starch Chemical Co., Ltd.) was used so as to have a content of 6 percent by weight in the sheet S to be obtained.

In addition, in this example, as the preliminary humidifying step, the humidification was performed by the humidifier 3D of the sorting portion 14. As shown in Table 1, the humidifier 3D performed humidification so that the moisture content of the first sorted material M4-1 was 10 percent by weight.

In addition, as the humidifying step, the humidification was performed by the humidifier 3G of the depositing portion 19. As shown in Table 1, the humidification was performed by the humidifier 3G so that the moisture content of the second web M8 was 20 percent by weight.

In addition, after one gram of the first sorted material M4-1 discharged from the drum 141 was sampled, the moisture content thereof was measured by a heating dry type moisture analyzer ("MS70", manufactured by A&D Company, Limited).

In a manner similar to that described above, after one gram of the mixture M7 discharged from the drum 181 was sampled, the moisture content thereof was measured by a heating dry type moisture analyzer ("MS70", manufactured by A&D Company, Limited).

Examples 2 to 6

Except for that the humidified position and the degree of humidification were changed as shown in Table 1, a sheet S was formed in a manner similar to that in Example 1.

In addition, in Examples 1 to 6, in the humidifying step, a mist type humidifier was used, and in the preliminary humidifying step, a vaporizing type humidifier was used.

Comparative Examples 1 to 5

Except for that the humidified position and the degree of humidification were changed as shown in Table 1, a sheet S was formed in a manner similar to that in Example 1.

In addition, in Comparative Examples 1 and 3 to 5, a mist type humidifier was used in the humidifying step, and in Comparative Example 2, a water spray humidifier was used. In addition, in Comparative Examples 4 and 5, a vaporizing type humidifier was used in the preliminary humidifying step.

2. Evaluation

The following evaluations were performed on the fiber bodies, that is, the sheets, obtained in the examples and the comparative examples.

2-1. Tensile Strength (Tensile Test)

A tensile test was performed on the sheet in accordance with JIS 8113, and the evaluation was performed as follows.

A: 20 [N·m/g] or more

B: 10 [N·m/g] to less than 20 [N·m/g]

C: 0 [N·m/g] to less than 10 [N·m/g]

2-2. Process Time

Under the conditions in which the binding property of the binding agent was sufficiently obtained in the second web M8, a time from a point at which the defibrated materials were dispersed in the sorting portion 14 to a point at which the second web M8 passed through the heating unit 202 was measured and was evaluated as follows.

A: 8 seconds/sheet or less

B: more than 8 seconds/sheet

The results thereof are collectively shown in Table 1. In addition, in Table 1, an item in which the numerical value of the moisture content of a material that passed through a certain portion is not described, that is, the item in which "–" is shown, indicates that no humidification is performed at the portion, and the latest moisture content is maintained. In addition, when the humidifier 3A performed no humidification, the moisture content of the raw material stocked in the raw material supply portion was 6 percent by weight.

TABLE 1

| | MOISTURE CONTENT OF MATERIAL AFTER PASSING THROUGH (PERCENT BY WEIGHT) | | | | | | | HUMIDIFICATION | | |
|---|---|---|---|---|---|---|---|---|---|---|
| | RAW MATERIAL SUPPLY PORTION | COARSELY PULVERIZING PORTION | CONSTANT AMOUNT SUPPLY PORTION | SORTING PORTION | FIRST WEB FORMING PORTION | DISPERSING PORTION | SECOND WEB FORMING PORTION | METHOD OF SECOND WEB FORMING PORTION | EVALUATION TENSILE STRENGTH | EVALUATION PROCESS TIME |
| EXAMPLE 1 | 6 | — | — | 10 | — | — | 20 | MIST | B | A |
| EXAMPLE 2 | 6 | — | 10 | 15 | — | — | 25 | MIST | A | A |
| EXAMPLE 3 | 10 | — | 15 | 20 | — | — | 30 | MIST | A | A |
| EXAMPLE 4 | 10 | 15 | — | 30 | — | — | 30 | MIST | A | A |
| EXAMPLE 5 | 6 | — | — | — | 15 | 20 | 25 | MIST | A | A |
| EXAMPLE 6 | 6 | — | — | — | — | 15 | 25 | MIST | A | A |
| COMPARATIVE EXAMPLE 1 | 6 | — | — | — | — | — | 10 | MIST | C | A |
| COMPARATIVE EXAMPLE 2 | 6 | — | — | — | — | — | 25 | WATER SPRAY | C | A |
| COMPARATIVE EXAMPLE 3 | 6 | — | — | — | — | — | 25 | MIST | A | B |
| COMPARATIVE EXAMPLE 4 | 3 | — | — | 7 | — | — | 25 | MIST | A | B |
| COMPARATIVE EXAMPLE 5 | 10 | — | 25 | 35 | — | — | 40 | MIST | B | B |

As apparent from Table 1, in Examples 2 to 6, excellent results can be obtained. On the other hand, in Comparative Examples 1 to 5, satisfied results cannot be obtained. In Comparative Example 1 to 3, since the preliminary humidification is not performed, the moisture content of the mixture M7 dispersed from the dispersing portion 18 is less than 10%. Hence, in Comparative Example 1, moisture necessary for the binding agent is not sufficient, and the evaluation of "tensile strength" is not good. In addition, in Comparative Example 2, although the humidifying step is rapidly performed by water spray, exhibition of the binding property varies, and as a result, the evaluation of "tensile strength" is not good. In addition, in Comparative Examples 3 and 4, although the humidifying step is performed by the mist type humidifier, in order to obtain a sufficient tensile strength, the production takes a long time. In addition, in Comparative Example 5, since the moisture amounts in the preliminary humidifying steps are excessively large, the heating step takes a long time.

What is claimed is:

1. A fiber body manufacturing method comprising:

performing preliminary humidification by humidifying a mixture such that the mixture has a moisture content of 10 to 30 percent by weight, the mixture containing a defibrated material which includes fibers and a binding agent which exhibits a binding property by moisture absorption;

sieving the mixture having the moisture content of 10 to 30 percent by weight, after the performing of the preliminary humidification;

depositing, to obtain a deposit, the mixture that has been sieved;

humidifying the deposit by imparting moisture by water vapor or mist to the binding agent in the deposit so as to exhibit the binding property, the humidifying being performed such that the deposit that has been humidified has a moisture content of 15 to 50 percent by weight; and forming the deposit that has been humidified into a fiber body.

2. The fiber body manufacturing method according to claim 1, wherein in the preliminary humidification, the mixture is humidified by supply of water vapor or mist.

3. The fiber body manufacturing method according to claim 1, wherein in the sieving, a moisture content of the fibers and a moisture content of the binding agent are each 50 percent by weight or less.

4. The fiber body manufacturing method according to claim 1, wherein the defibrated material is obtained by coarsely pulverizing a raw material including the fibers, followed by performing defibration, and the preliminary humidification is performed before the raw material is defibrated.

5. The fiber body manufacturing method according to claim 4, wherein the raw material contains the binding agent, and a content of the binding agent in the raw material is 1 to 50 percent by weight.

6. The fiber body manufacturing method according to claim 1, wherein a content of the binding agent in the fiber body formed in the forming is 1 to 25 percent by weight.

* * * * *